United States Patent [19]

Löwenberg

[11] Patent Number: 4,962,297

[45] Date of Patent: Oct. 9, 1990

[54] TEMPERATURE CONTROLLED HOT PLATE

[75] Inventor: Eva G. U. Löwenberg, Stockholm, Sweden

[73] Assignee: Aktiebolaget Electrolux, Stockholm, Sweden

[21] Appl. No.: 435,530

[22] PCT Filed: Mar. 30, 1989

[86] PCT No.: PCT/SE89/00163

§ 371 Date: Jan. 17, 1990

§ 102(e) Date: Jan. 17, 1990

[87] PCT Pub. No.: WO89/09532

PCT Pub. Date: Oct. 5, 1989

[30] Foreign Application Priority Data

Mar. 30, 1988 [SE] Sweden ..... 8801195

[51] Int. Cl.[5] ..... H05B 3/70

[52] U.S. Cl. ..... 219/449; 219/464

[58] Field of Search ..... 219/448, 449, 459, 460, 219/461, 462, 464, 465

[56] References Cited

U.S. PATENT DOCUMENTS 3,885,128 5/1975 Dills ..... 219/457
3,895,216 7/1975 Hurko ..... 219/464
4,716,277 12/1987 Schreder ..... 219/449

FOREIGN PATENT DOCUMENTS 1288704 2/1969 Fed. Rep. of Germany ..... 219/449
820616 9/1959 United Kingdom ..... 219/449

*Primary Examiner*—Teresa J. Walberg
*Attorney, Agent, or Firm*—Pearne, Gordon, McCoy & Granger

[57] ABSTRACT

A temperature controlled hot plate (10) has a hot plate body (11) having an upper plane heat emitting surface (12) and a lower surface on which the heating coil (13) is provided. The heating coil is embedded in an electrically insulating substance (14) against which an elongated temperature sensor is pressed such that it is directly influenced by the heat emitted by the heating coil (13). The temperature sensor is of a kind containing an expandable medium, such as a liquid or the like. According to a preferred embodiment the temperature sensor is arranged so as to follow the heating coil along essentially the whole of its length, straight below said heating coil. According to a further preferred embodiment a cup-shaped bottom washer (24) is arranged to press the temperature sensor (16) against the insulating substance as well as against an annular flange (15) surrounding the heat generating area and being an integral part of the hot plate body (11).

5 Claims, 1 Drawing Sheet

TEMPERATURE CONTROLLED HOT PLATE

BACKGROUND OF THE INVENTION

The present invention relates to a temperature controlled hot plate.

Temperature controlled hot plates are known in which there is provided a recess in the center of the hot plate for a temperature sensor. By a spring the sensor is pressed into engagement with a cooking utensil placed on the hot plate. An example of such a hot plate is given in the Swedish patent No. 448 508. In a hot plate of this kind, according to the principle of regulation used the parameter of regulation is the temperature prevailing on the bottom surface of the cooking utensil. When the control temperature has been reached the hot plate body, most often being made of cast iron, has a heat content stored which continues to supply heat to the cooking utensil even after the disconnection of the hot plate. This gives rise to undesirable overshoots in the control temperature graph of the hot plate.

As appears from the Swedish patent No. 446 243, for example, the heating of liquid in a cooking utensil to cooking temperature can be performed at maximum power up to a predetermined temperature and from this point the continued cooking can take place at this predetermined temperature without any appearance of overshoots in the control temperature graph. However, in connection with this heating process there is a demand for advanced electronic control arrangements to be provided which for cost reasons are considered unrealistic in common ranges and cooking hobs.

Another disadvantage in the arrangement described in the first-mentioned patent is the requirement for an operation to be performed in the hot plate for mounting of the temperature sensor which, in addition, has a relatively complex design with a cup-shaped thin plate which is to be pressed upwards into contact with a cooking utensil. Here, the arrangement is unnecessarily complicated and, accordingly, costly in relation to ordinary power-regulated hot plates.

SUMMARY

The object of the invention is to remedy the drawbacks indicated and to provide a temperature controlled hot plate wherein the temperature sensor has been given a different design which makes possible the mounting of the temperature sensor on a common hot plate which does not need to be modified. In addition, the sensor need not to be movably mounted.

BRIEF DESCRIPTION OF THE DRAWINGS

The invention will now be described more in detail in connection with a few embodiments with reference to the enclosed drawings.

DESCRIPTION OF THE PREFERRED EMBODIMENT

Figure 1:
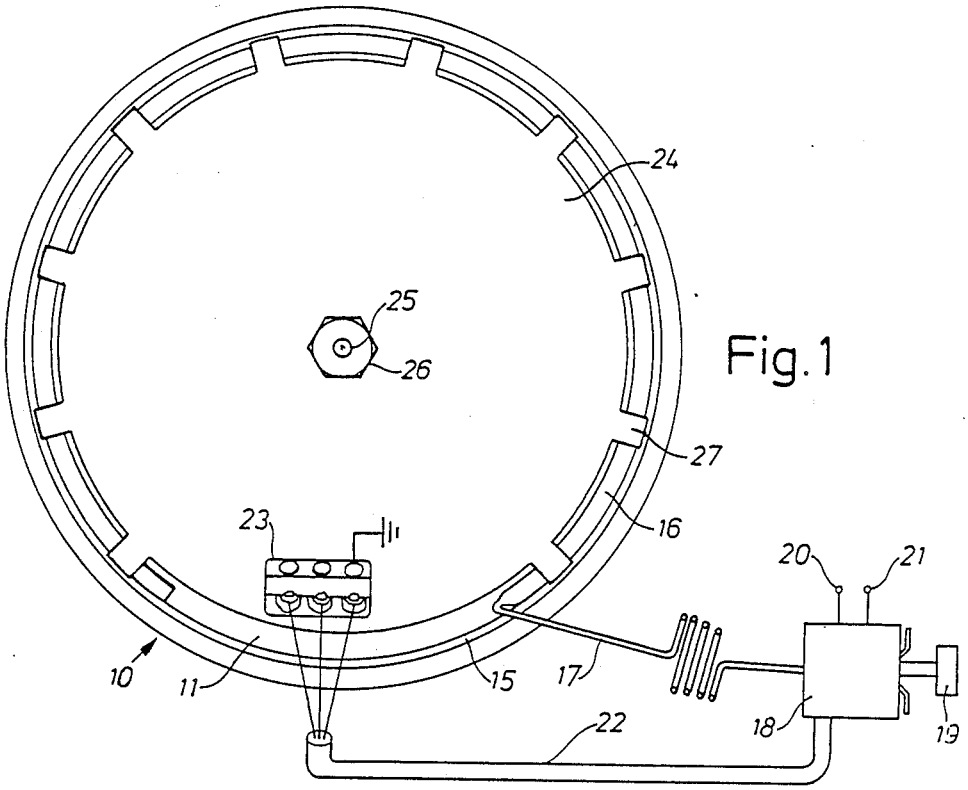
FIG. 1 shows a cast iron hot plate as seen from below.
Figure 2:
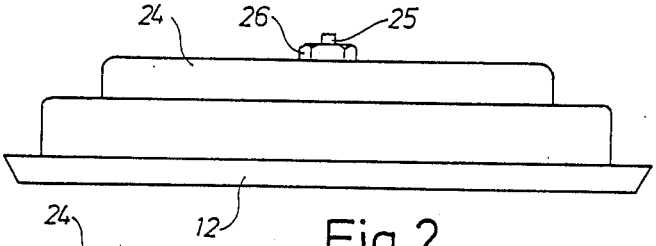
FIG. 2 is a side view of the hot plate of FIG. 1.

In FIGS. 1 and 2 a common cast iron hot plate 10 is shown comprising a plate body 11 having an upper plane heat emitting surface 12 on which a cooking utensil is to be placed. The body also has a lower surface on which a heating coil is disposed along a helical path.

The heating coil is enclosed in an electrically insulating substance 14 and the heat generating area i surrounded by an angular flange 15 being an integral part of the hot plate body. Of course, instead of a single heating coil also several different coils can be provided which can be interconnected in different ways to give different nominal power ratings for the hot plate.

Figure 3:
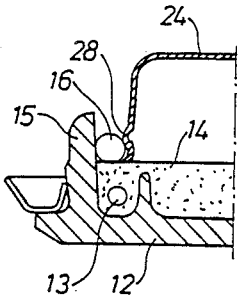
FIGS. 3, 4 and 5 are detail sectional views showing the mounting on the hot plate of the temperature sensor of the invention.
Figure 4:
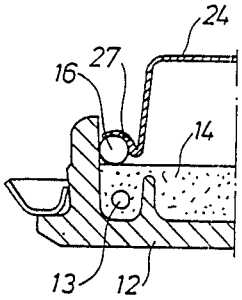
Figure 5:
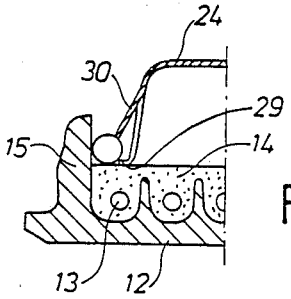

An elongated tubular temperature sensor 16 is being secured to the bottom of the hot plate in such a way that is contacts the insulating substance 14 and follows the angular flange 15. The temperature sensor contains an expandable medium, such as a liquid or a cream-like mixture of sodium and potassium which is particularly useful at high temperatures. As shown in FIGS. 3–5 essentially one turn of the heating coil 13 is situated adjacent to the flange and hence straight below the temperature sensor 16. As a result the temperature sensor will be in heat conducting connection both with the heating coil, via the insulating substance 14, and with the hot plate body 11 via the flange 15. In the usual way, via a capillary 17 the temperature sensor is connected to a thermostat 18 by which various operating temperatures of the hot plate can be set by the use of a turning knob 19. Via terminals 20, 21 the thermostat 18 is connected to an AC mains and, in addition, by a line 22 to a connection box 23 to which also the heat coil is connected.

The temperature sensor can be secured to the hot plate in the position shown in different ways. In the examples shown a cup-shaped bottom plate 24 has been used which is disposed below the hot plate to increase electric security. The bottom plate is secured to the hot plate by means of a center bolt 25 and a nut 26. In the embodiment of FIG. 1 the bottom plate 24 has lugs 27 which in positions distributed along the periphery bear against the temperature sensor to press it downwards against the insulating substance 14 as well as outwards against the flange 15. This embodiment is also shown in FIG. 4.

As shown in FIG. 3, in an alternative embodiment the bottom plate 24 can be provided with an annular bead 28 pressing against the temperature sensor.

Another embodiment is shown in FIG. 5 where the bottom plate has a bent-out edge 29 as well as lugs 30 distributed along the periphery as in FIG. 1. The edge 29 and the lugs 30 co-operate to press the temperature sensor against the insulating substance 14 and against the angular flange 15.

In order to have as small difference as possible between the maximum temperature and the minimum temperature, respectively, of the hot plate for each temperature value set by the turning knob 19 it is important that the temperature sensor as well as possible senses the temperature of the heating coil. As a result the thermostat will react quickly on the heat supplied and the hot plate can be disconnected before it has reached too high a temperature. In principle, the temperature sensor can be fixed to the bottom of the hot plate such that it follows any of the turns of the heating coil. However, the most optimal results have been achieved when, in addition, the temperature sensor has been brought into contact with the hot plate body. There exists no closer explanation to this phenomenon.

Hence, optimum results have been achieved in the embodiments shown in the drawings with the temperature variation amounting to $\pm 10°$ C. at the hot plate temperatures commonly used.

I claim:

1. A temperature controlled hot plate (10) with a plate body (11) comprising an upper plane heat emitting surface and a lower surface on which at least one heating coil (13) is provided enclosed in insulating (14), an elongated temperature sensor (16) being arranged to be pressed against the insulation (14) to be directly influenced by heat emitted by the heating coil (13), the sensor containing an expandable fluid, and the hot plate body being provided with an annular flange (15) surrounding the insulation, characterized in that the heating coil (13) along part of its length follows the annular flange (15) at some distance from the flange, and that the temperature sensor (16) is disposed along the border between the insulation (14) and the flange (15) so as to be in metallic contact with the flange.

2. A hot plate according to claim 1, characterized in that the plate body (11) has a center bolt (25) for securing of a bottom plate (24) made of metal, the bottom plate being arranged to press the temperature sensor (16) against the insulation (14) and against the flange (15).

3. A hot plate according to claim 2, characterized in that the bottom plate (24) is cup-shaped and is provided with bent-out lugs (27) which engage with the temperature sensor (16) so as to press the sensor against the insulation (14) as well as against the flange (15).

4. A hot plate according to claim 2, characterized in that the bottom plate (24) is cup-shaped with an annular edge situated adjacent the temperature sensor (16), wherein at some distance from the edge the bottom plate (24) is provided with an annular bead (28) which engages with the sensor (16) along a line situated such that the sensor is pressed against the insulation (14) as well as against the flange (15).

5. A hot plate according to claim 2, characterized in that the bottom plate (24) is cup-shaped with an annular edge situated adjacent the temperature sensor and having a bent-out portion (29) which engages with the temperature sensor (16) from one side to press it against the flange (15) a number of lugs (30) being bent out from a side wall of the bottom plate (24), said lugs resiliently engaging with the temperature sensor (16) to press it against the flange (15) as well as against the insulation (14).

* * * * *

UNITED STATES PATENT AND TRADEMARK OFFICE

CERTIFICATE OF CORRECTION

PATENT NO. : 4,962,297

DATED : October 9, 1990

INVENTOR(S) : Eva G. U. Lowenberg

It is certified that error appears in the above-identified patent and that said Letters Patent is hereby corrected as shown below:

Column 2, line 10, delete "is" and insert --it--.

Column 3, line 5, delete "insulating" and insert --insulation--.

Signed and Sealed this

Tenth Day of March, 1992

*Attest:*

*Attesting Officer*

HARRY F. MANBECK, JR.

*Commissioner of Patents and Trademarks*